US009273425B2

(12) United States Patent
Kim et al.

(10) Patent No.: US 9,273,425 B2
(45) Date of Patent: Mar. 1, 2016

(54) APPARATUS FOR TREATING LAUNDRY AND METHOD FOR CONTROLLING THE SAME

(75) Inventors: Jinwoong Kim, Seoul (KR); Jaewon Chang, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1175 days.

(21) Appl. No.: 13/080,112

(22) Filed: Apr. 5, 2011

(65) Prior Publication Data

US 2011/0265271 A1 Nov. 3, 2011

(30) Foreign Application Priority Data

Apr. 5, 2010 (KR) ..... 10-2010-0031080
Apr. 5, 2010 (KR) ..... 10-2010-0031081

(51) Int. Cl.
*D06F 39/14* (2006.01)
*D06F 37/42* (2006.01)

(52) U.S. Cl.
CPC ..... *D06F 39/14* (2013.01); *D06F 37/42* (2013.01); *D06F 2224/00* (2013.01)

(58) Field of Classification Search
CPC ..... D06F 39/14; D06F 37/42; D06F 2224/00
USPC ..... 68/12.26, 196
See application file for complete search history.

(56) References Cited

U.S. PATENT DOCUMENTS 5,323,628 A * 6/1994 Mori et al. ..... 68/12.26
5,823,017 A * 10/1998 Hapke et al. ..... 68/12.26
2002/0101313 A1* 8/2002 Dirnberger et al. ..... 335/220
2003/0160461 A1* 8/2003 Promutico ..... 292/216
2005/0223506 A1* 10/2005 Kwen et al. ..... 8/159
2006/0006027 A1* 1/2006 Carlson et al. ..... 188/267.2
2006/0012190 A1* 1/2006 Alacqua et al. ..... 292/341.16
2008/0100066 A1* 5/2008 Mueller et al. ..... 292/24
2009/0251032 A1* 10/2009 Jeon et al. ..... 312/220
2010/0077803 A1* 4/2010 Lim et al. ..... 68/212
2010/0283362 A1* 11/2010 Choi ..... 312/228

FOREIGN PATENT DOCUMENTS

CN 1467326 A 1/2004
CN 1746388 A 3/2006
CN 1884673 A 12/2006
CN 101298735 A 11/2008
EP 0 610 824 B1 8/1996
EP 2048274 A1 * 4/2009 ..... A47L 15/42
JP 2004-065408 A 3/2004
KR 10-2003-0038250 A 5/2003
KR 10-2009-0079793 A 7/2009
WO WO 2006004317 A1 * 1/2006 ..... D06F 37/28

* cited by examiner

*Primary Examiner* — Joseph L Perrin
(74) *Attorney, Agent, or Firm* — Dentons US LLP

(57) ABSTRACT

Provided are an apparatus for treating laundry and a method for controlling the same. The laundry treating apparatus includes a cabinet, a drum, a motor, a door, and a door switch. The cabinet defines an external appearance and has a laundry loading hole for laundry. The drum houses the laundry and is rotatably installed. The motor rotates the drum. The door is rotatably coupled to the cabinet to open and close the laundry loading hole. The door switch allows the door to be closed. Here, when close protection is set by manipulation of a close protection button, or the drum vibrates without rotation of the motor, the door switch allows the door not to be closed.

10 Claims, 21 Drawing Sheets

APPARATUS FOR TREATING LAUNDRY AND METHOD FOR CONTROLLING THE SAME

The present application claims priority to Korean Application No. 10-2010-0031080 filed in Korea on Apr. 5, 2010, and Korean Application No. 10-2010-0031081 filed in Korea on Apr. 5, 2010, the entire contents of which are hereby incorporated by reference in their entirety.

BACKGROUND

1. Technical Field

The present invention relates to an apparatus for treating laundry and a method for controlling the same, and more particularly, to an apparatus for treating laundry and a method for controlling the same, which can set a door not to be closed and prevent an accident when a child enters the drum.

2. Description of the Related Art

Generally, a laundry treating apparatus is a common designation for various kinds of treating apparatus that treat laundry by applying physical and chemical actions to the laundry, such as a washing machine that removes contaminants from clothes, bedding, etc. (hereinafter, referred to as 'laundry') using a chemical decomposition action of water and detergent, and a physical action, such as friction, between water and laundry; a drying machine that dries wet laundry by spinning; and a refresher that sprays heated steam to the laundry for preventing the occurrence of allergic reaction due to the laundry and, in addition, for easily and conveniently washing the laundry.

When a child enters the laundry treatment apparatus, and then a door thereof is closed, the child may be suffocated because the child could not open the door.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
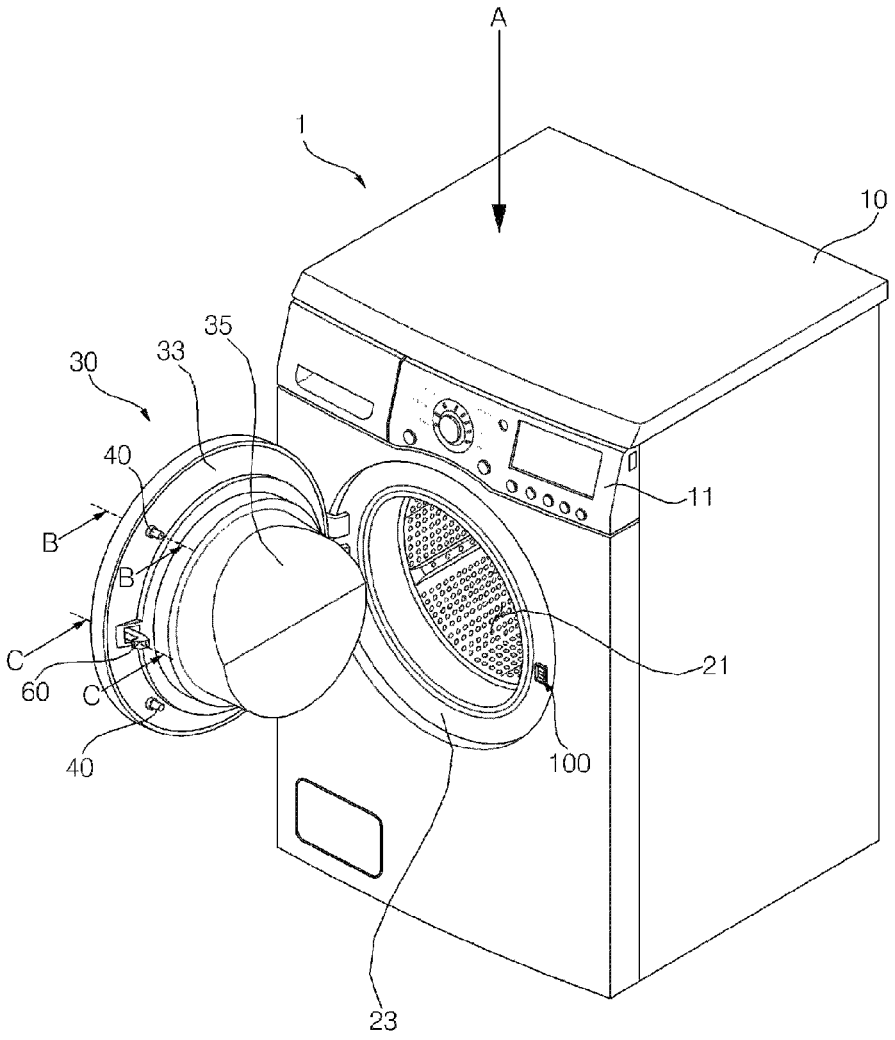
FIG. 1 is a perspective view illustrating a laundry treating apparatus according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Now, exemplary embodiments of a laundry treating apparatus and a method for controlling the same according to the present invention will hereinafter be described in detail with reference to the accompanying drawings.

Figure 2:
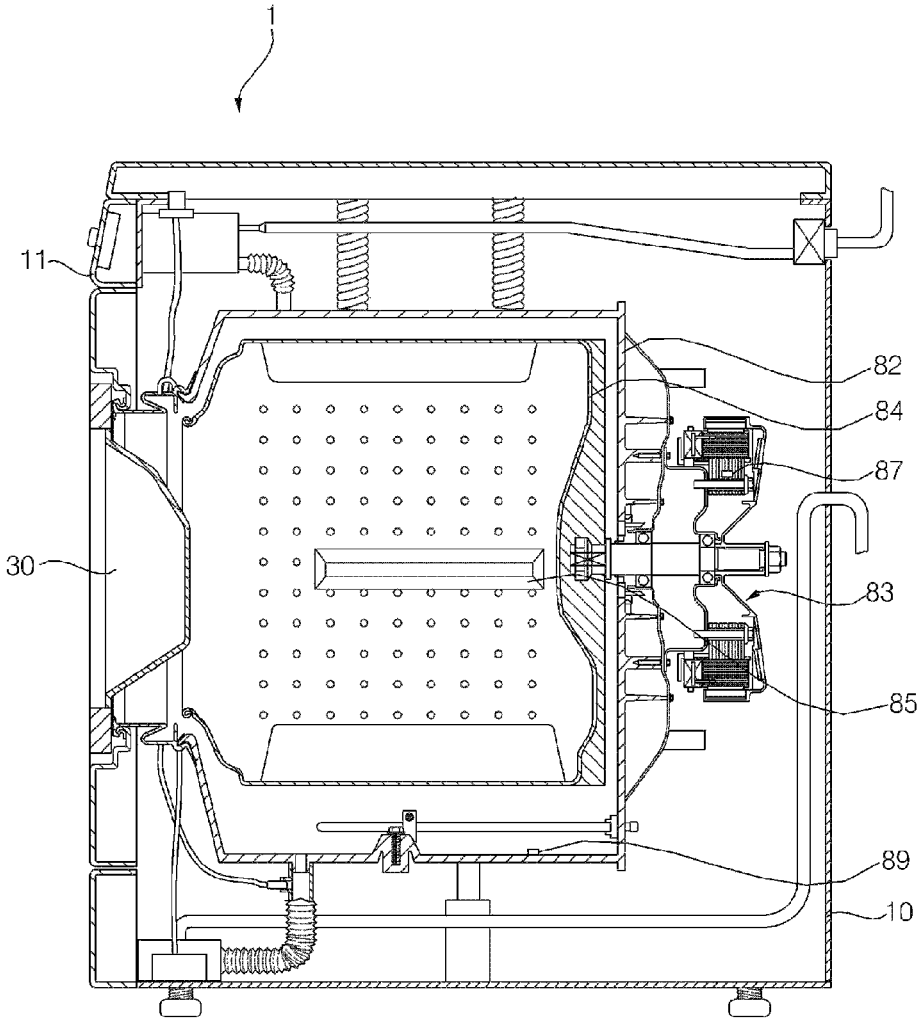
FIG. 2 is a cross-sectional view taken in a direction of the arrow A of FIG. 1.
Figure 3:
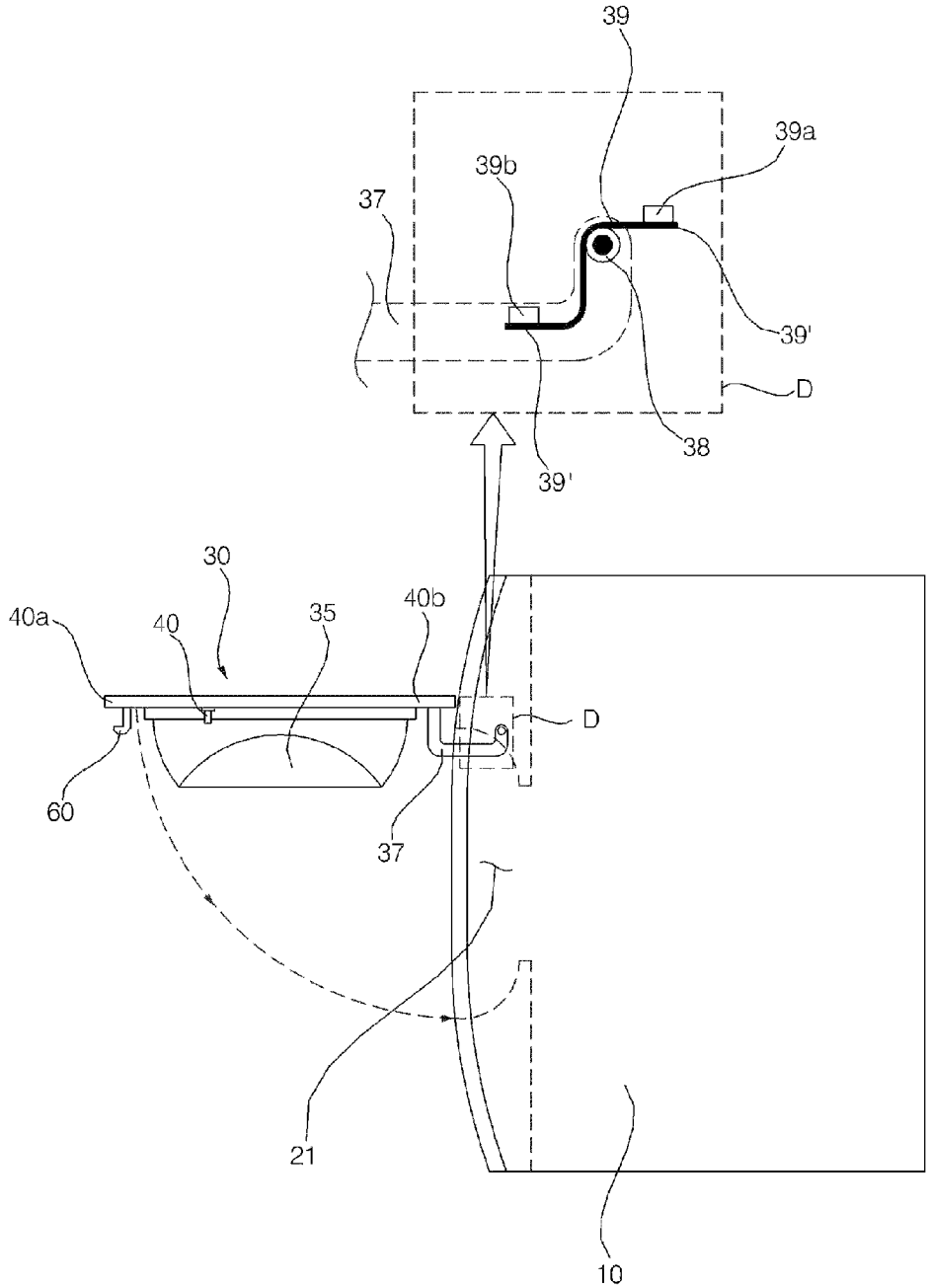
FIG. 3 is a plan view taken in a direction of the arrow A of FIG. 1.

FIG. 1 is a perspective view illustrating a laundry treating apparatus according to an embodiment of the present invention. FIG. 2 is a cross-sectional view taken in a direction of the arrow A of FIG. 1. FIG. 3 is a plan view taken in a direction of the arrow A of FIG. 1.

In the present embodiment, a laundry treating apparatus 1 includes a cabinet 10 for accommodating laundry therein, the cabinet 10 having a laundry loading hole 21 for introducing the laundry therethrough, a door 30 rotatably mounted to the front of the cabinet 10 for opening and closing the laundry loading hole 21, a tub 82 disposed inside the cabinet 10 and storing wash water supplied from the outside, a drum 84 disposed inside the tub 82 and housing laundry, and a motor 83 for supplying a rotational force to the drum 84.

The cabinet 10 defines an external appearance of the laundry treating apparatus 1. The cabinet 10 houses the laundry therein and has a laundry loading hole 21. A door seating part 23 for receiving the door 30 is formed around the laundry loading hole 21 of the cabinet 10.

The door 30 includes a transparent part 35 having a circular shape and formed of a transparent material, and a door frame 33 forming the circumference of the transparent part 35.

The door 30 has one end 40*b* rotatably coupled to the door seating part 23 of the cabinet 10 via a door hinge 38. The door 30 moves toward the laundry loading hole 21 while rotating about the door hinge 38, and is seated on the door seating part 23 to close the laundry loading hole 21.

The door hinge 38 is provided with a door elastic member 39 having one end 39' supported by a first support part 39*a* formed in the cabinet 10 and the other end 39" supported by a second support part 39*b* formed at a hinge rod 37 connected to the door 30. The door elastic member 39 provides elastic force in a direction in which the door 30 opens away from the laundry loading hole 21. The door elastic member 39 may be in a form of a torsion spring provided at the door hinge 38.

A hook 60 is disposed at the other end 40*a* of the door 30. The hook 60 is latched to a door switch 100 (see, for example, FIG. 5) provided at the door seating part 23 for latching the door 30 to prevent the door 30 from being opened and to prevent wash water from leaking outside during washing. The hook 60 is rotatably coupled to the door 30 such that the hook 60 can be latched to or latch released from the door switch 100.

When the door 30 is closed, the hook 60 is latched to the door switch 100. When the treatment of laundry is completed, the door switch 100 releases the hook 60 to open the door 30. Details thereof will be described in detail later.

A control panel 11 receives a laundry course selection or various operation commands such as operation time and reservation for each cycle, or displays the operation state of the laundry treating apparatus 1.

The tub 82 is disposed in the cabinet 10 shock-absorbably by a spring (not shown) and a damper (not shown). The tub 82 houses wash water. The drum 84 is disposed in the tub 82. The drum 84 housing laundry rotates. The drum 84 is rotatably disposed in the tub 82. The drum 84 receives a rotational force from a driving unit 83 and rotates. A lifer 85 is mounted in the drum 84 to raise wash water during the rotation of the drum 84. The motor 83 rotates the drum 84. The motor 83 may include a switching device and a clutch for the control of the motor 83.

A rotation sensor 87 measures a rotation speed value of the motor 83 to sense whether the motor 83 rotates. The rotation sensor 87 may measure the rotation speed value of the motor 83 by measuring a current or voltage outputted from a motor or a switching device for controlling the motor. A hall sensor may be used to measure the rotation speed value of the motor 83 by sensing a magnetic field of the motor 83. In the present embodiment, the rotation sensor 87 is implemented using a hall sensor and is provided in the motor 83.

A vibration sensor 89 measures a vibration value to detect whether the drum 84 vibrates. The vibration sensor 89 may be implemented using various sensors that can measure the vibration value of the drum 84. According to an embodiment of the present invention, an accelerometer may be applied. The accelerometer may be installed in horizontal and vertical directions to sense vibration of various directions.

Since the vibration sensor 89 may not be directly provided in the drum 84 that rotates, it is provided in the tub 82 or the cabinet 10. In the present embodiment, the vibration sensor 89 is provided in the tub 82.

The laundry treating apparatus 1 determines whether a child has entered the drum 84 through the rotation sensor 87 and the vibration sensor 89. When the rotation sensor 87 does not sense the rotation of the motor 83, and the vibration sensor 89 senses the vibration of the drum 84, that is, the motor 83 does not rotate and the drum 84 vibrates, the laundry treating apparatus determines that a child has entered the drum 84, and automatically opens the door 30 or allows the door 30 not to be closed.

Figure 4:
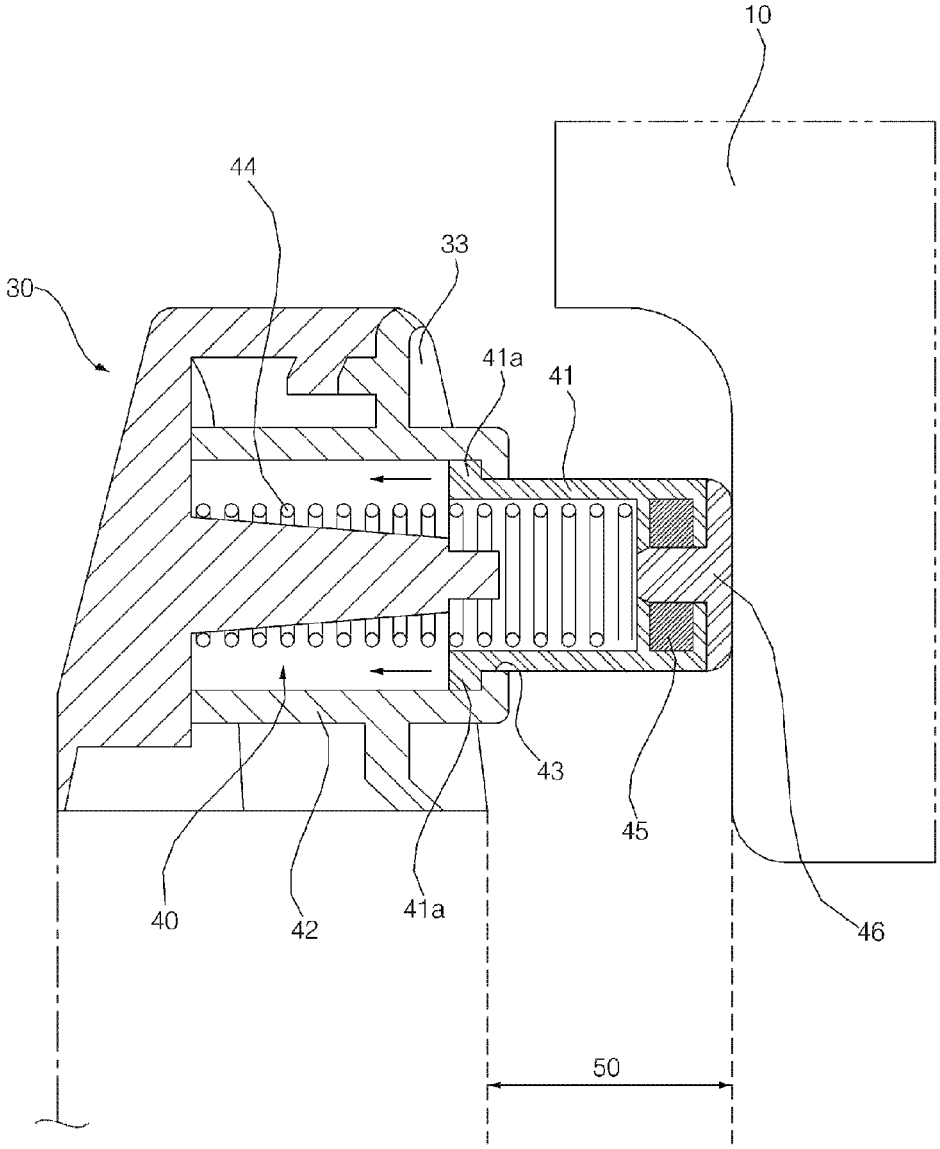
FIG. 4 is a cross-sectional view taken along line B-B in a door of the laundry treating apparatus of FIG. 1.

FIG. 4 is a cross-sectional view taken along line B-B in a door of the laundry treating apparatus of FIG. 1

Referring to FIG. 4, the laundry treating apparatus 1 according to this embodiment may further include a support unit 40 mounted in the door 30 that contacts the cabinet 10 when the door 30 is opened and maintains a certain separation gap 50 between the door 30 and the cabinet 10. In the present embodiment, the support unit 40 is provided in the door 30. However, this should not be construed as a limitation. For example, the support unit 40 may be provided in the cabinet 10.

The support unit 40 achieves communication between the interior and exterior of a drum 84 rotatably disposed in the cabinet 10 through the separation gap 50 between the door 30 and the door seating part 23.

The support unit 40 includes a support body 41 disposed so as to move inwardly or outwardly of the door 30 and a mount frame 42 having an insertion hole 43 formed inside the door 30 such that the support body 41 is inserted into and protrudes from the insertion hole 43.

When the hook 60 is released from the door switch 100, and, as a result, the door 30 opens from the door seating part 23, the support body 41 contacts the cabinet 10 to maintain the separation gap 50 between the cabinet 10 and the door 30.

In a state where the door 30 is opened, the support body 41 rotates and contacts the cabinet 10 before the hook 60 is latched to the door switch 100. Thus, the separation gap 50 may be formed between the cabinet 10 and the door 30.

The mount frame 42 may be formed at the door frame 33 as one body. The support body 41 is inserted into the insertion hole 43 of the mount frame 42. A separation preventing protrusion 41*a* for preventing the separation of the support body 41 from the insertion hole 43 may be formed at the support body 41 as one body. The depth of the insertion hole 43 may be greater than at least the length of the support body 41.

The support body 41 is elastically supported with respect to the cabinet 10 by a support elastic member 44. When the hook 60 is released from the door switch 100, the support elastic member 44 applies elastic force to the support body 41 to maintain the separation gap 50 between the door 30 and the cabinet 10 in cooperation with the door elastic member 39.

The support unit 40 may further include a magnet 45 mounted at the tip end of the support body 41 for magnetically coupling the support body 41 with the cabinet 10. The magnet 45 is formed of a material having magnetic properties. The door seating part 23 of the cabinet 10, to which the support body 41 comes into contact at the magnet 45, is preferably formed of a material exhibiting high magnetic coupling with the magnet 45, e.g., metal.

The support unit 40 further includes a contact part at the tip end of the support body 41 that may prevent noise from being generated during contact between the support body 41 and the cabinet 10.

The contact part 46 is coupled to the tip end of the support body 41 to prevent noise from being generated when the magnet 45 or the tip end of the support body 41 comes into direct contact with the door seating part 23 of the cabinet 10, formed of metal. The contact part 46 may be formed of silicone or rubber so as to minimize noise generated during contact.

Figure 5:
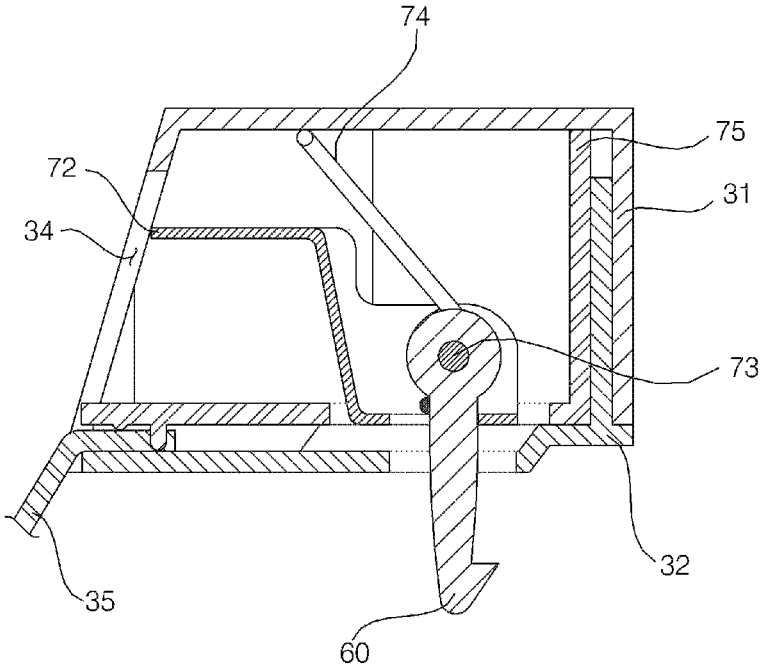
FIG. 5 is a cross-sectional view taken along line C-C in a door of the laundry treating apparatus of FIG. 1.

FIG. 5 is a cross-sectional view taken along line C-C in a door of the laundry treating apparatus of FIG. 1.

Referring to FIG. 5, the door 30 may be provided with a door handle 72. A user may manipulate the door handle 72 to open the door 30. The door handle 72 is rotatably provided inside the door 30. The door handle 72 is operatively connected to the hook 60 such that the hook is rotated simultaneously with the rotation of the door handle 72.

A handle casing 75 may be provided such that the door handle 72 is mounted in the handle casing 75. The door handle 72 is provided in the handle casing 75 such that the door handle 72 is rotated about a handle hinge 73. The hook 60 may be coupled to the handle hinge 73. Also, the hook 60 may be operatively connected to the door handle 72 such that the hook 60 is rotated simultaneously when the door handle 72 is rotated.

When a user grips the door handle 72 through an opening 34 of the handle casing 75 from the front of the door 30 in a state where the door 30 is closed, the door handle 72 and the hook 60 are rotated together, and the hook 60 is released from the door switch 100, allowing the door 30 to be openable.

When the hook 60 is released from the door switch 100, the door 30 rotates in the opening direction of the door 30 by the restoring property of the door elastic member 38 provided at the door hinge 38 and the support elastic member 44.

On the other hand, a handle elastic member 74 may be provided between the door handle 72 and the handle casing 75 such that the hook 60 returns to the original position thereof when the user releases the door handle 72.

Figure 6:
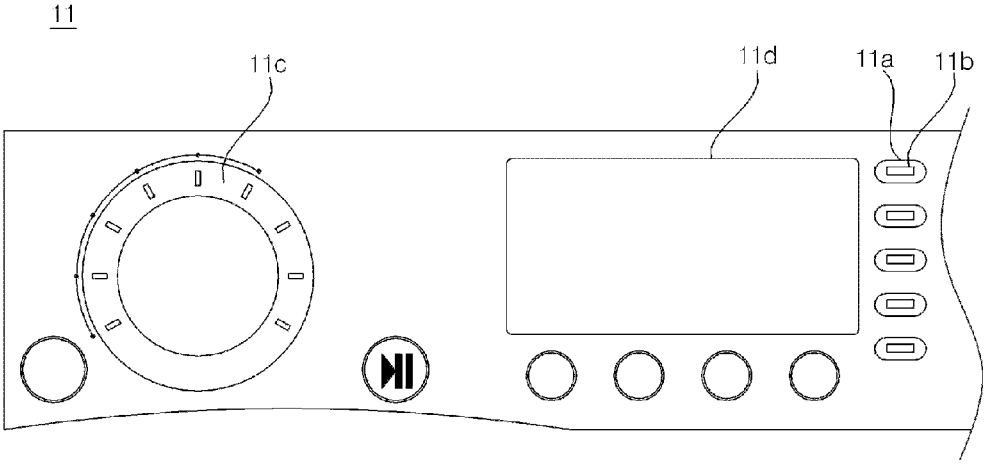
FIG. 6 is a view illustrating a control panel of a laundry treating apparatus according to an embodiment of the present invention.

FIG. 6 is a view illustrating a control panel of a laundry treating apparatus according to an embodiment of the present invention.

A control panel 11 according to an embodiment of the present invention includes a close protection button 11*a* for allowing the door 30 not to be closed, a close protection display 11*b* for representing that close protection is set, a course selector 11*c* for selecting a method for treating laundry, and a state display 11*d* for displaying the operation state of the laundry treating apparatus 1.

The close protection button 11*a* is set by a user such that the door is not closed. When the close protection button 11*a* is set in close protection mode by a user, the door switch 100 is allowed not to be latched by the hook 60. The close protection button 11*a* may be automatically set in close protection mode when laundry starts.

When the close protection button 11*a* is set in close mode, the close protection display 11*b* displays the setting state of the close protection button 11*a*. The close protection display 11*b* may include a light emitting diode to display the operation state of the close protection button 11*a* with light. According to embodiments, the close protection display 11*b* may be included in the state display 11*d* to be displayed as an icon.

The course selector 11*c* is an input device that allows a user to set the laundry course. In the present embodiment, the course selector 11*c* may be implemented as a dial form or a button form, and may also be implemented as a touchscreen combined with the state display 11*d*. The laundry course may include a lingerie/wool course, a boiling course, and a functional clothing course. In the present embodiment, a close protection course for setting a close protection mode after the completion of laundry may be included. When the close protection course is selected from the course selector 11*c*, the door switch 100 is allowed not to be latched by the hook 60, and the close protection display 11*b* or the state display 11*d* indicates that the close protection mode has been set.

The state display 11*d* displays the operation state of the laundry treating apparatus 1, including the progress state of the laundry. The state display 11*d* may display the operation state of the laundry treating apparatus 1 using icons or figures, and may display whether close protection is set.

Figure 7:
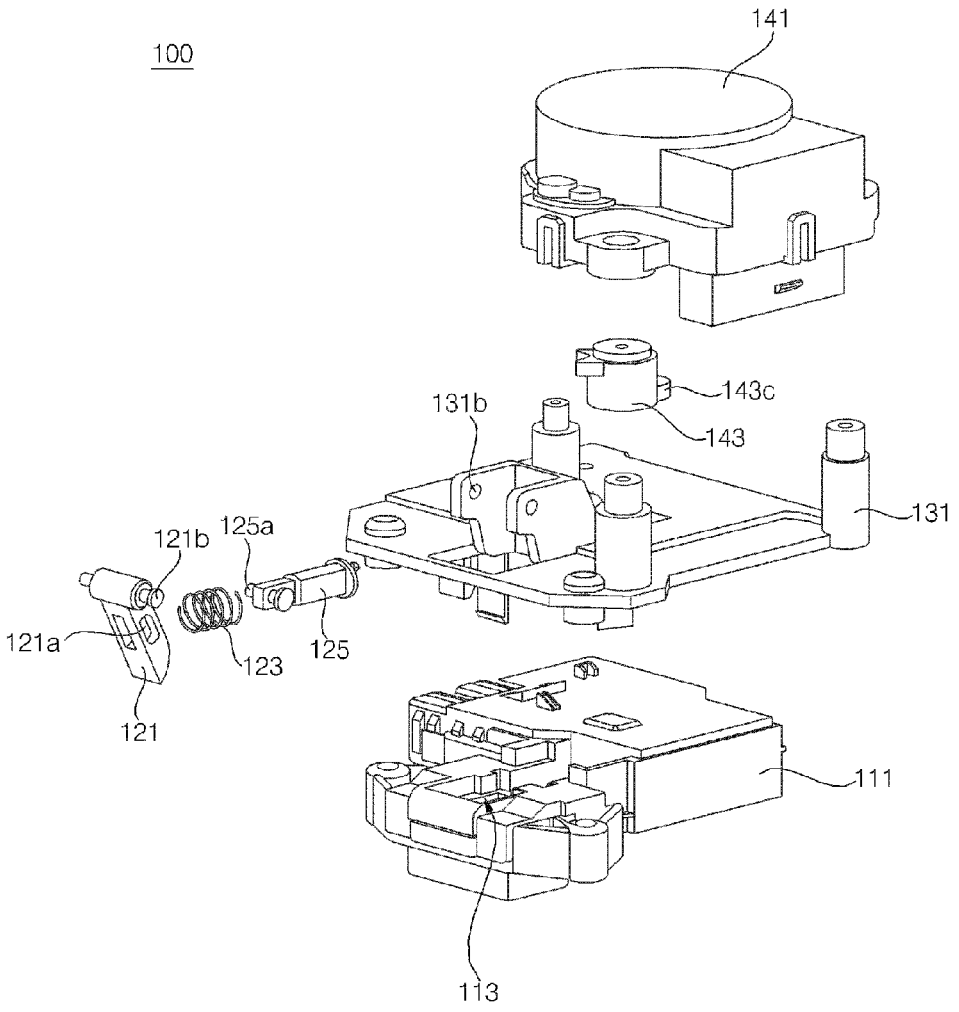
FIG. 7 is an exploded perspective view illustrating a door switch of a laundry treating apparatus according to an embodiment of the present invention.
Figure 8:
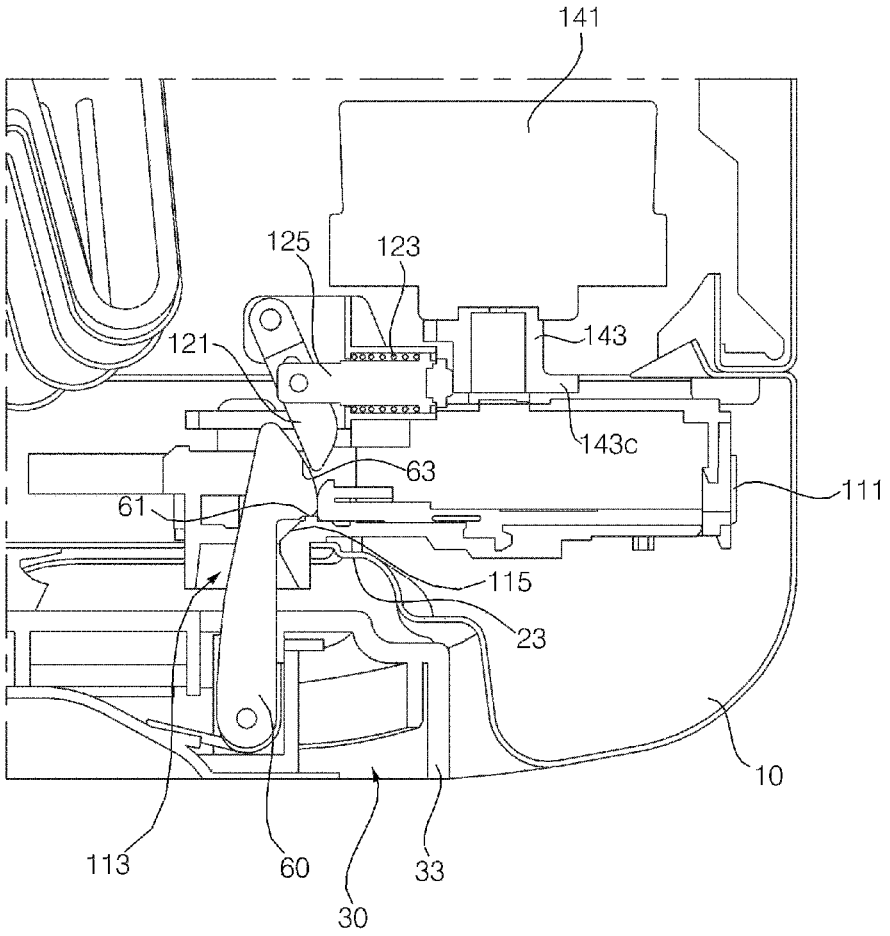
FIG. 8 is a view illustrating a latched door switch of FIG. 7.
Figure 9:
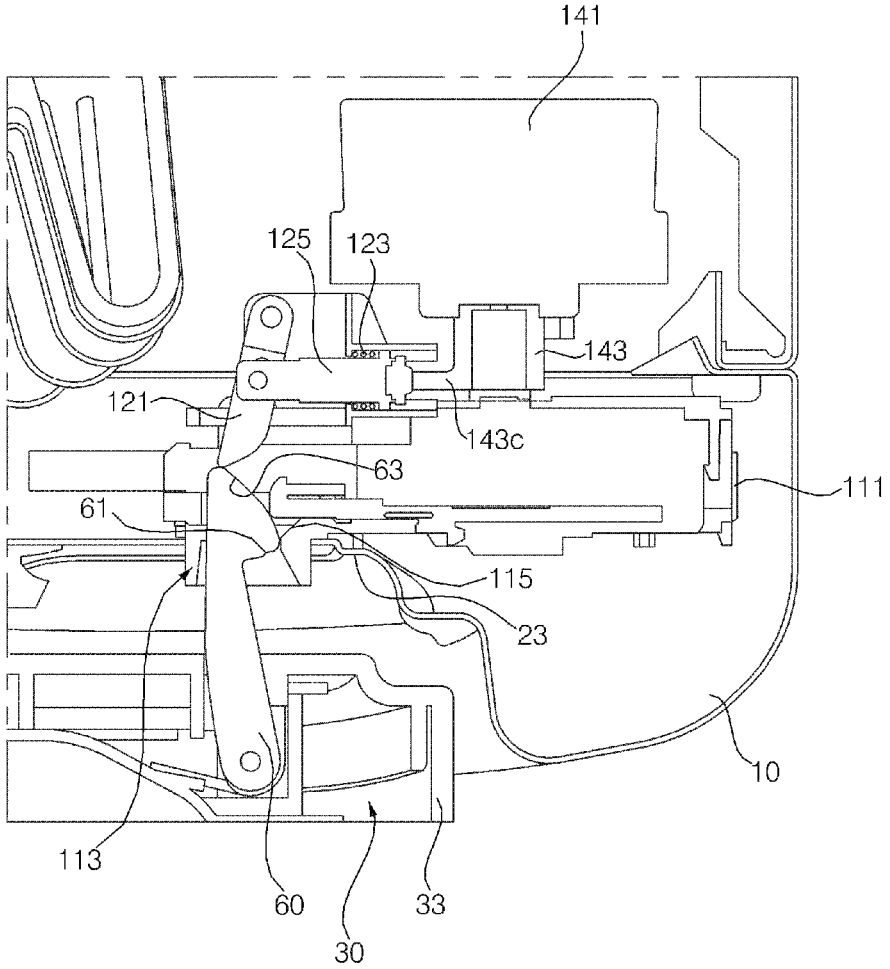
FIG. 9 is a view illustrating an unlatched door switch of FIG. 7.

FIG. 7 is an exploded perspective view illustrating a door switch of a laundry treating apparatus according to an embodiment of the present invention. FIG. 8 is a view illustrating a latched door switch of FIG. 7. FIG. 9 is a view illustrating an unlatched door switch of FIG. 7.

In the present embodiment, the door switch 100 includes a lower switch body 111 to which the hook 60 is latched, an upper switch body 131 coupled to the lower switch body 111, a motor 141 for generating rotational force, a cam 143 configured to be rotated by the motor 141, a follower 125 configured to contact the cam 143 for performing a rectilinear motion, and a lever 121 driven by the follower 125 for releasing the hook 60.

The lower switch body 111 is provided with a hook hole 113, into which the hook 60 is inserted. The lower switch body 111 is provided with a switch latch part 115, to which a hook latch part 61 of the hook 60 is latched when the door 30 is closed. The hook latch part 61 latches to the switch latch part 115 when the door 30 is closed.

The motor 141, the cam 143, the follower 125, and the lever 121 are provided at the upper switch body 131. The upper switch body 131 and the lower switch body 111 constitute a switch body.

The motor 141 generates rotational force to rotate the cam 143. The motor 141 is preferably provided at the upper switch body 131. The motor 141 is preferably a synchronous motor suitable for driving the cam 143.

The cam 143 is rotated by the motor 141. A cam protrusion 143*c* is formed at the cam 143. When the door 30 is closed, the cam protrusion 143*c* is positioned in the direction opposite to the follower 125, as shown in FIG. 6. The cam protrusion 143*c* is rotated by the motor 141 to push the follower 125, as shown in FIG. 8.

The follower 125 is rectilinearly moved by the cam 143. The follower 125 is moved forward by the cam protrusion 143*c* of the cam 143. The follower 125 is moved backward by the switch elastic member 123. The follower 125 is preferably slidably coupled to the upper switch body 131. The follower 125 has a follower rotation shaft 125*a*, which is preferably coupled in a lever hole 121*a* formed in the lever 121.

The motor 141, the cam 143, and the follower 125 may be referred to as a lever driver for driving the lever 121.

The lever 121 is driven by the follower 125 to push the hook 60 such that the hook 60 is released from the door switch 100. The lever 121 has a lever rotation shaft 121*b*, which is preferably coupled in an upper switch hole 131*b* formed in the upper switch body 131. The lever 121 is rotated by the follower 125 to push a hook head 63 of the hook 60 such that the hook 60 is rotated.

Hereinafter, the operation of the door switch 100 with the above-stated construction according to this embodiment will be described.

When laundry treatment is completed by the laundry treating apparatus 1 or the motor 83 does not rotate and the drum 84 vibrates, the motor 141 rotates the cam 143. When the cam 143 is rotated, the cam protrusion 143*c* of the cam 143 pushes the follower 125 such that the follower 125 performs a rectilinear motion. When the follower 125 is moved forward, the lever 121 is rotated to push the hook head 63 of the hook 60. When the hook head 63 is pushed, the hook 60 is rotated.

When the hook 60 is rotated, the hook latch part 61 is released from the switch latch part 115, with the result that the hook 60 is released from the door switch 100. When the hook 60 is released from the door switch 100, the support elastic member 44 of the support unit 40 applies elastic force to the support body 41 such that the door 30 is rotated, whereby the door 30 is opened. At this time, the door 30 may be rotated by elastic force of the door elastic member 39.

Since the support body 41 contacts the door seating part 23 of the cabinet 10 by magnetic force of the magnet 45 of the support unit 40 in spite of opening of the door 30, the door 30 may be opened by the separation gap 50.

Figure 10:
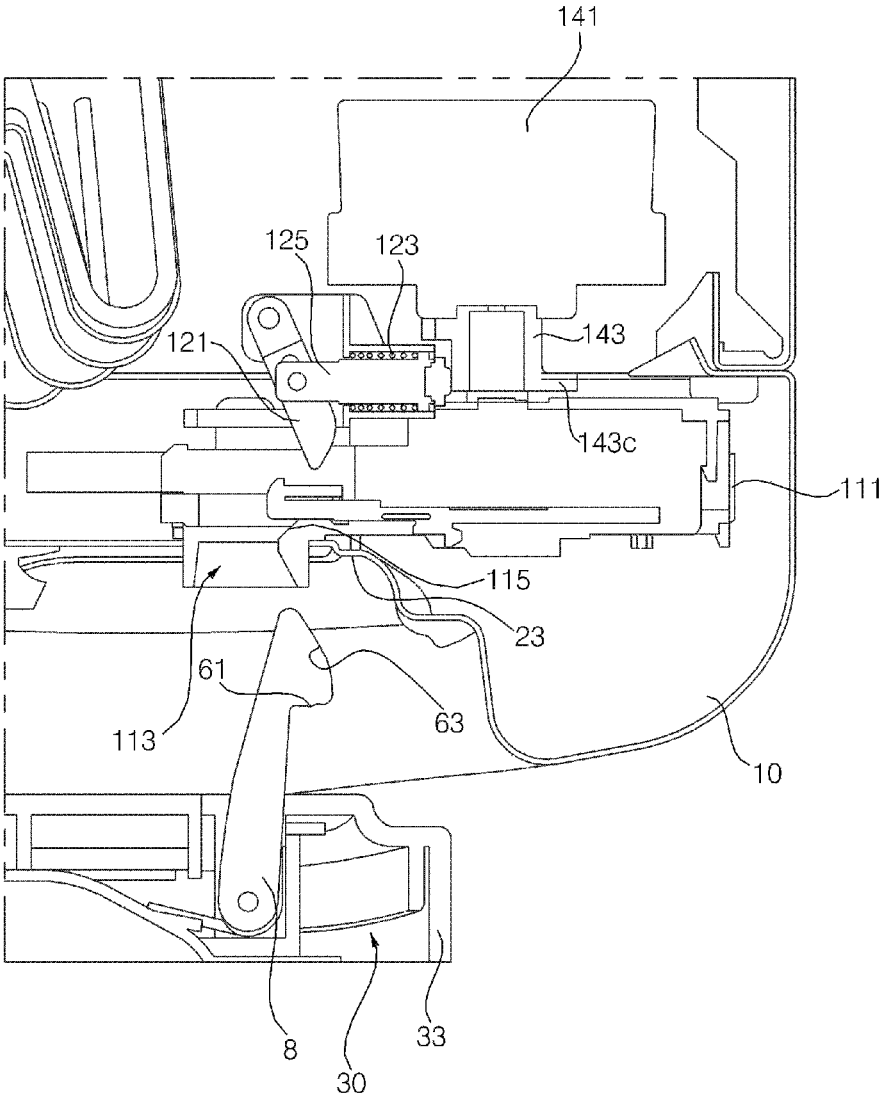
FIG. 10 is a view illustrating a state of a door that can be closed because close protection is not set or vibration does not occur in a drum of the laundry treating apparatus of FIG. 7.

FIG. 10 is a view illustrating a state of a door that can be closed because close protection is not set or vibration does not occur in a drum of the laundry treating apparatus of FIG. 7.

After the door switch 100, as shown in FIG. 9, releases the hook 60 to automatically open the door 30, the close protection may not be set or the drum may not vibrate. In this case, the motor 141 rotates the cam 143 to allow the follower 125 to be moved backward by the switch elastic member 123. When the follower 125 moves backward in a straight line, the lever 121 rotates and returns to the original position, and the door 30 becomes closable.

In a state where the door 30 is closed as shown in FIG. 8, when a user manipulates the door handle 72 to open the door 30, and then the close protection is not set or the drum 84 does not vibrate, the level 121 maintains the original position without the operation of the motor 141, and the door stays closable.

Figure 11:
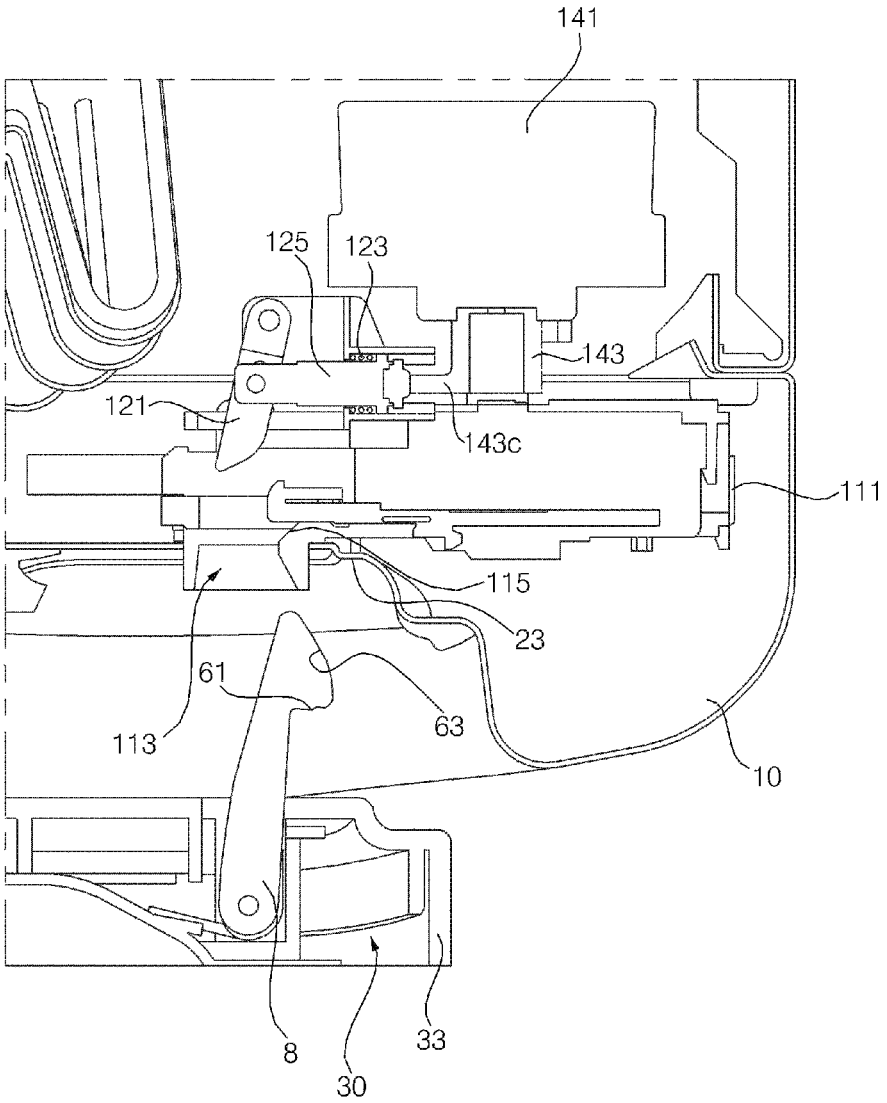
FIG. 11 is a view illustrating a state of a door that is not closed because close protection is set or vibration occurs in a drum without rotation of a motor in the laundry treating apparatus of FIG. 7.

FIG. 11 is a view illustrating a state of a door that is not closed because close protection is set or vibration occurs in a drum without rotation of a motor in the laundry treating apparatus of FIG. 7.

When the door switch 100 releases the hook 60 to automatically open the door 30 as shown in FIG. 9, and then the close protection is not set or the drum 83 vibrates without rotation of the motor 83, the motor 141 does not rotate to allow the lever 121 to stay rotated. In this case, when a user intends to close the door 30, as shown in FIG. 9, the lever 121 contacts the hook 60 to allow the hook 60 not to be latched to the lower switch body 111. Accordingly, the door 30 becomes unclosable.

In a state where the door 30 is closed as shown in FIG. 8, when a user manipulates the door handle 72 to open the door 30, or the door switch 100 releases the hook 60 to automatically open the door 30 as shown in FIG. 9, and then the door is in the closable state as shown in FIG. 10, the close protection may not be set, or the motor 83 may not rotate but the drum 84 may vibrate. In this case, the motor 141 rotates the cam 143. When the cam 143 rotates, the cam protrusion 143*c* of the cam 143 pushes the follower 125 in the straight line. When the follower 125 moves forward by the straight-line motion, the lever 121 rotates. In this case, if a user intends to close the door 30, as shown in FIG. 9, the lever 121 contacts the hook 60 to allow the hook 60 not to be latched to the lower switch body 111. Accordingly, the door 30 becomes unclosable.

Figure 12:
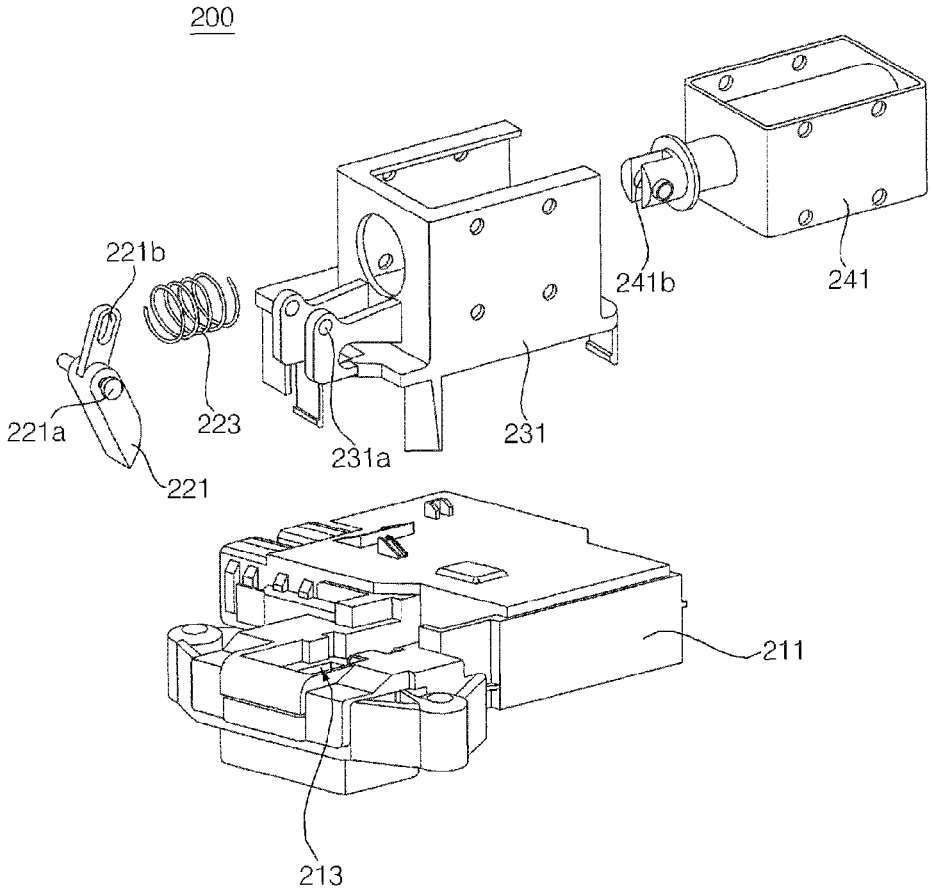
FIG. 12 is an exploded perspective view illustrating a door switch of a laundry treating apparatus according to another embodiment of the present invention.
Figure 13:
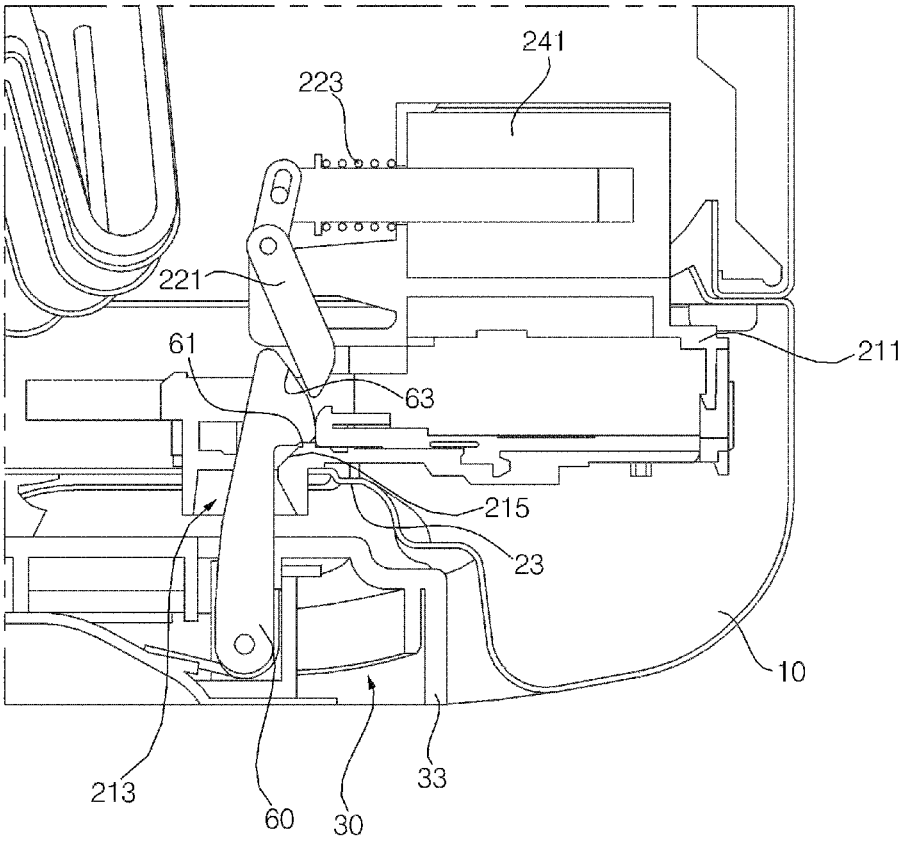
FIG. 13 is a view illustrating a latched door switch of FIG. 12.
Figure 14:
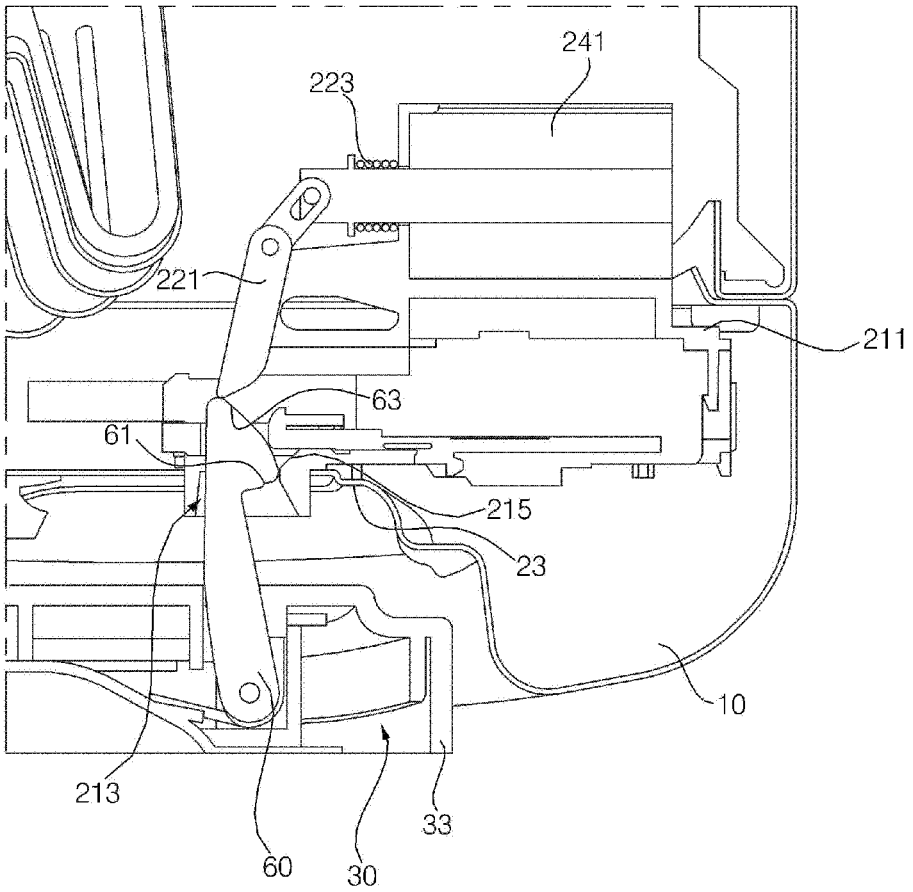
FIG. 14 is a view illustrating an unlatched door switch of FIG. 12.

FIG. 12 is an exploded perspective view illustrating a door switch of a laundry treating apparatus according to another embodiment of the present invention. FIG. 13 is a view illustrating a latched door switch of FIG. 12. FIG. 14 is a view illustrating an unlatched door switch of FIG. 12.

In the present embodiment, a door switch 200 includes a lower switch body 211 to which the hook 60 is latched, an upper switch body 231 coupled to the lower switch body 211, a solenoid 241 for generating rectilinear force, and a lever 221 driven by the solenoid 241 for releasing the hook 60.

A detailed description of components of the door switch 200 similar to those of the previous embodiment of the present invention will be omitted herein.

The solenoid 241 generates rectilinear force to move the lever 221. When the door 30 is closed, the solenoid 241 protrudes as shown in FIG. 10. When an electric signal is inputted, the solenoid 241 is moved backward, as shown in FIG. 11, to pull the lever 221. The solenoid 241 has a solenoid rotation shaft 241*b*, which is preferably coupled in a lever hole 221*b* formed in the lever 221.

The lever 221 is driven by the solenoid 241 to push the hook 60 such that the hook 60 is released. The lever 121 has a lever rotation shaft 221*a*, which is preferably rotatably coupled in an upper switch hole 231*a* formed in the upper switch body 231. The lever 221 is rotated by the solenoid 241 to push the hook head 63 of the hook 60 such that the hook 60 is rotated.

Hereinafter, the operation of the door switch 200 with the above-stated construction according to this embodiment will be described.

When laundry treatment is completed by the laundry treating apparatus 1, or the motor 83 does not rotate and the drum 84 vibrates, the solenoid 241 is rectilinearly moved backward. As a result, the lever 221 is rotated to push the hook head 63 of the hook 60. When the hook head 63 is pushed, the hook 60 is rotated.

When the hook 60 is rotated, the hook latch part 61 is released from a switch latch part 215, with the result that the hook 60 is separated from the door switch 200. When the hook 60 is separated from the door switch 100, the support elastic member 44 of the support unit 40 applies elastic force to the support body 41 such that the door 30 is rotated, whereby the door 30 is opened. At this time, the door 30 may be rotated by elastic force of the door elastic member 39.

Since the support body 41 is in contact with the door seating part 23 of the cabinet 10 by magnetic force of the magnet 45 of the support unit 40 in spite of opening of the door 30, the door 30 is opened by the separation gap 50.

Figure 15:
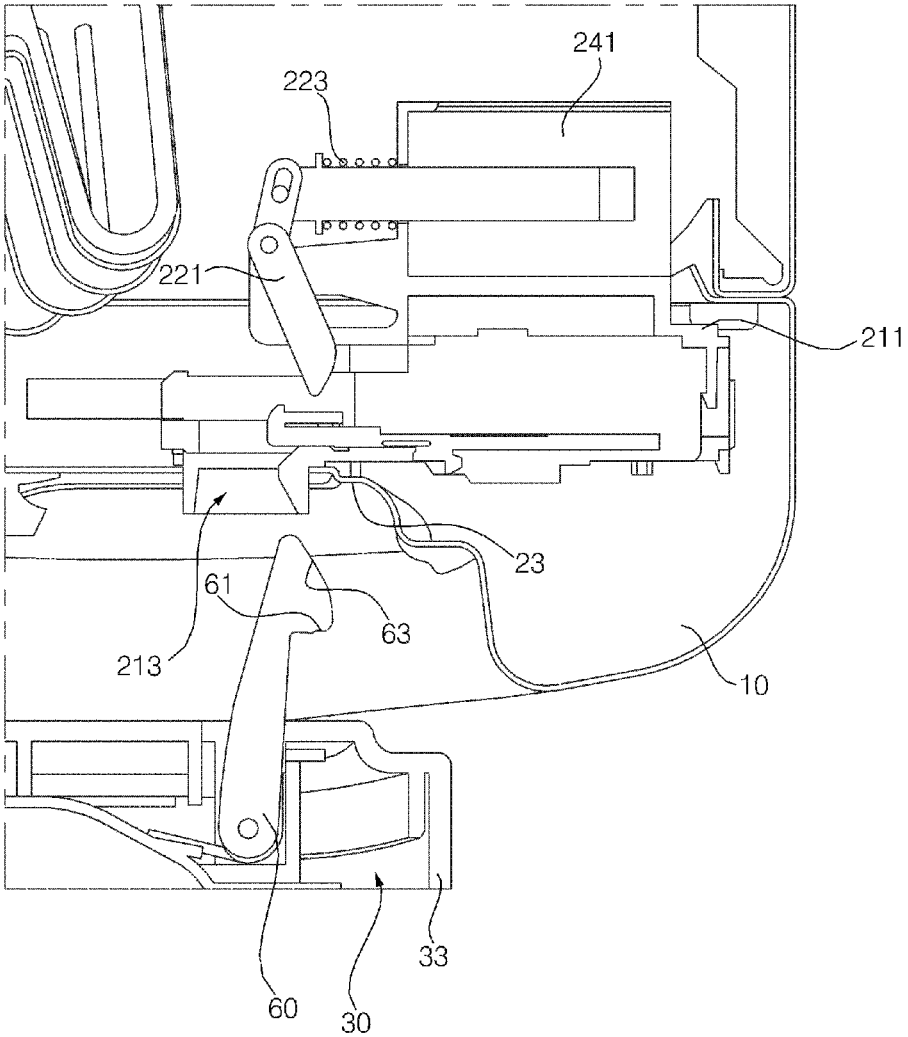
FIG. 15 is a view illustrating a state of a door that can be closed because close protection is not set or vibration does not occur in a drum of the laundry treating apparatus of FIG. 12.

FIG. 15 is a view illustrating a state of a door that can be closed because close protection is not set or vibration does not occur in a drum of the laundry treating apparatus of FIG. 12.

When the door switch 200 releases the hook 60 to automatically open the door 30 as shown in FIG. 14, and then the close protection is not set or the drum doest not vibrate, the solenoid 241 may be moved forward by the solenoid elastic member 223. In this case, the lever 221 rotates and returns to the original position, and the door 30 becomes closable.

In a state where the door 30 is closed as shown in FIG. 13, when a user manipulates the door handle 72 to open the door 30, and then the close protection is not set or the drum 84 does not vibrate, the level 221 maintains the original position without the operation of the solenoid 241, and the door stays closable.

Figure 16:
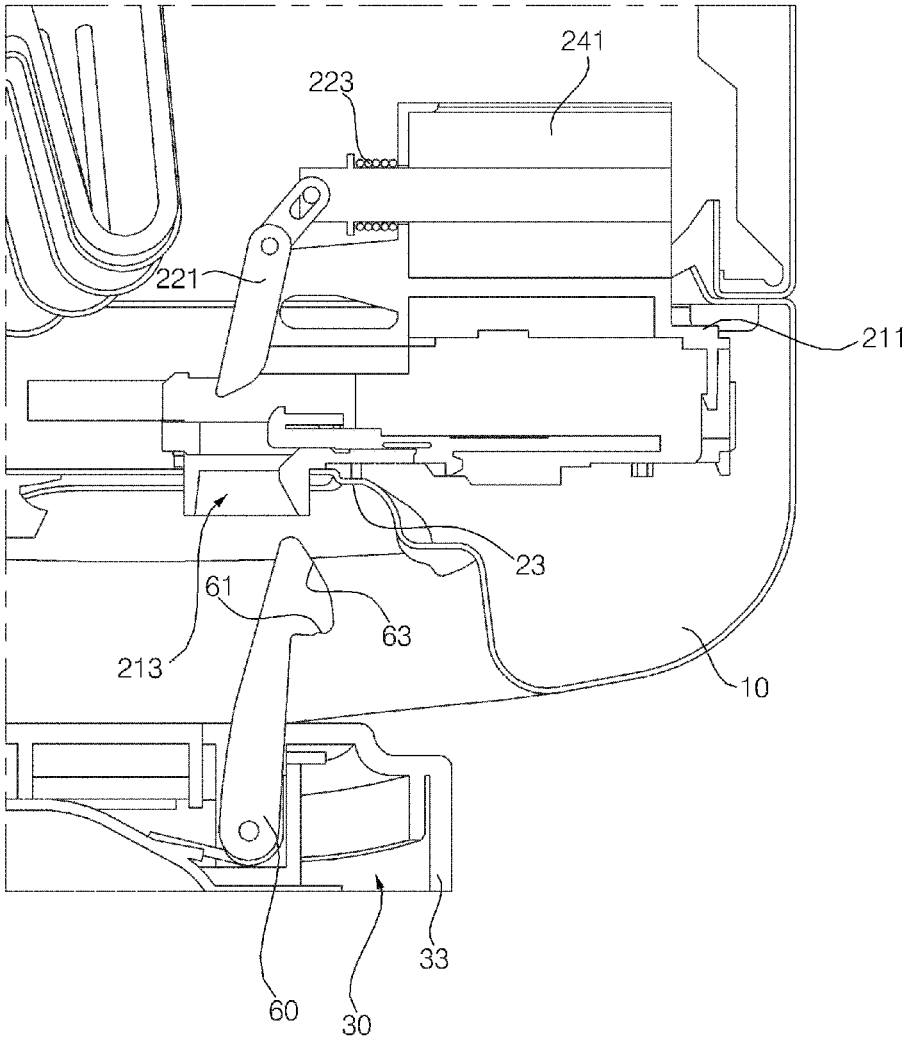
FIG. 16 is a view illustrating a state of a door that is not closed because close protection is set or vibration occurs in a drum without rotation of a motor in the laundry treating apparatus of FIG. 12.

FIG. 16 is a view illustrating a state of a door that is not closed because close protection is set or vibration occurs in a drum without rotation of a motor in the laundry treating apparatus of FIG. 12.

When the door switch 200 releases the hook 60 to automatically open the door 30 as shown in FIG. 14, and then the close protection is not set or the drum 83 vibrates without rotation of the motor 83, the solenoid 241 does not operate to maintain the lever 221 rotated. In this case, when a user intends to close the door 30, as shown in FIG. 14, the lever 221 contacts the hook 60 to allow the hook 60 not to be latched to the lower switch body 211. Accordingly, the door 30 becomes unclosable.

In a state where the door 30 is closed as shown in FIG. 13, when a user manipulates the door handle 72 to open the door 30, or the door switch 200 releases the hook 60 to automatically open the door 30 as shown in FIG. 14, and then the door is in the closable state as shown in FIG. 15, the close protection may not be set, or the motor 83 may not rotate but the drum 84 may vibrate. In this case, the solenoid 241 moves backward in a straight-line to rotate the lever 221. In this case, if a user intends to close the door 30, as shown in FIG. 14, the lever 221 contacts the hook 60 to allow the hook 60 not to be latched to the lower switch body 211. Accordingly, the door 30 becomes unclosable.

Figure 17:
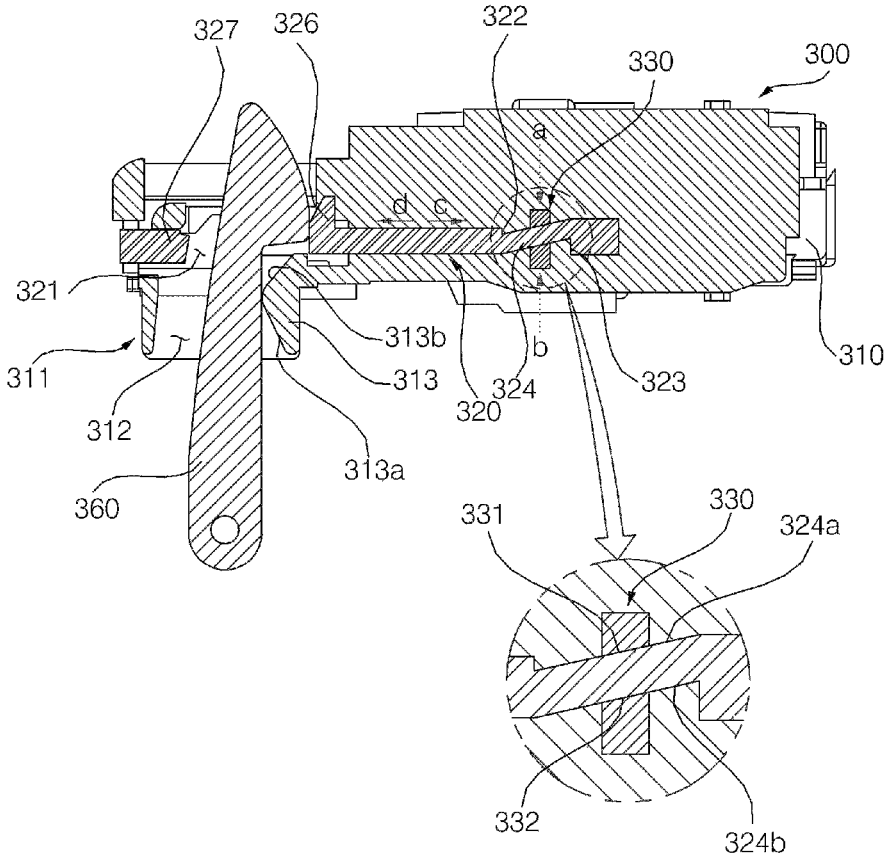
FIG. 17 is a cross-sectional view illustrating a coupling structure between a hook and a door switch in a laundry treating apparatus according to still another embodiment of the present invention.

FIG. 17 is a cross-sectional view illustrating a coupling structure between a hook and a door switch in a laundry treating apparatus according to still another embodiment of the present invention.

Referring to FIG. 17, a door switch 300 includes a switch body 310 defining an external appearance thereof and having a hook insertion part 311 into which the hook 360 is inserted, a slider 320 slidably provided in the switch body 310 and rotating the hook 360 to allow the door 30 to be automatically opened or not to be closed, and a slider actuator 330 for transmitting force from a driver, which will be described later, to the slider 320 to actuate the slider 320.

Although not shown in FIG. 17, the driver may be disposed in the switch body 310. Alternatively, the driver may be disposed outside the switch body 310 to transmit driving force to the slider actuator 330 through an additional connection member, such as a link (not shown). The hook insertion part 311 may include a hook insertion hole 312 and a hook latch part 313 formed around the hook insertion hole 312 in a protruding shape such that the hook 360 is latched to the hook latch part 313.

The hook latch part 313 may have an insertion inclined plane 313*a* formed in an inclined shape such that the hook 360 is smoothly inserted when the door 30 is closed and a release inclined plane 313*b* formed in an inclined shape reverse to the inclined shape of the insertion inclined plane 313*a* such that the hook 360 is smoothly released when the door 30 is opened.

The slider 320 may include a slider inclined plane 324 inserted into the slider actuator 330 for converting the direction of force applied from the slider actuator 330 as the slider actuator 330 moves upward and downward such that the slider 320 moves left and right, a first stopper 322 configured to be latched to the slider actuator 330 for limiting the movement distance of the slider 320 in the right direction, and a second stopper 323 configured to be latched to the slider actuator 330 for limiting the movement distance of the slider 320 in the left direction.

The slider actuator 330 may include a first actuator part for applying force to the slider 320 during downward movement and a second actuator part for applying force to the slider 320 during upward movement. Referring to FIG. 17, in the present embodiment, the first actuator part includes a first actuation plane 331 configured to be in plane contact with the slider inclined plane 324 of the slider 320 for generating sufficient frictional force. In the same manner, the second actuator part may include a first actuation plane 332.

The slider 320 may include a first conversion plane 324*a* corresponding to the first actuation plane 331 and a second conversion plane 324*b* corresponding to the second actuation plane 332 for converting the direction of force applied from the slider actuator 330, when the slider actuator 330 moves upward and downward, such that the slider 320 moves left and right.

Hereinafter, the movement direction of the slider 320 or the slider actuator 330 will be described. In FIG. 17, the downward direction is indicated by an arrow A (direction A), the upward direction is indicated by an arrow B (direction B), the right direction is indicated by an arrow C (direction C), and the left direction is indicated by an arrow D (direction D). Direction C is a direction in which the slider 320 moves such that the door 30 becomes closable. Direction D is a direction in which the slider 320 moves to rotate the hook 60 such that the door 30 is automatically opened or becomes unclosable. Direction A is a direction in which the slider actuator 330 moves to move the slider 320 in direction C. For example, direction A may be a direction in which the slider actuator 330 is not perpendicular to but at a certain angle to the first conversion plane 324*a* formed at the slider 320. Direction B is a direction in which the slider actuator 330 moves to move the slider 320 in direction D. For example, direction B may be a direction in which the slider actuator 330 is not perpendicular to but at a certain angle to the second conversion plane 324*b* formed at the slider 320.

Figure 18:
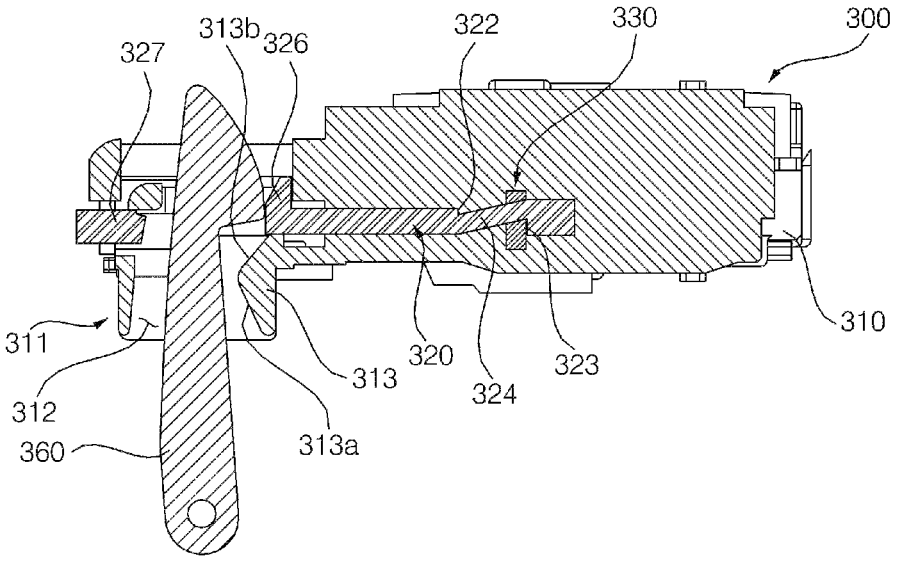
FIG. 18 is a view illustrating a state of a door that is automatically opened and is unclosable in the laundry treating apparatus of FIG. 17.

FIG. 18 is a view illustrating a state of a door that is automatically opened and is unclosable in the laundry treating apparatus of FIG. 17.

First, automatic opening of the door 30 will be described as follows.

In a state where the door 30 is closed as shown in FIG. 17, when a user opens the door 30, or the motor 83 does not rotate and drum 84 vibrates, the slider actuator 330 moves in direction b, and the slider 320 moves in direction D. In this case, the hook release part 326 pushes the hook 60 to allow the hook 60 to rotate in a counterclockwise direction and be released from the hook latch part 313. In this case, the door 30 rotates in an automatically opening direction by the elasticity of the support unit 40 and the door elastic member 39 provided in the door 30, and the hook 60 is released from the door switch 300.

In this case, since the support body 41 contacts the door seating part 23 of the cabinet 10 by magnetic force of the magnet 45 of the support unit 40 in spite of opening of the door 30, the door 30 may be opened by the separation gap 50.

Next, the unclosable state of the door 30 will be described as follows.

When the door switch 300 releases the hook 60 to automatically open the door 30 as shown in FIG. 18, and then the close protection is not set or the drum 83 vibrates without rotation of the motor 83, the slider actuator 330 does not operate to maintain the slider 320 moved in direction D. In this case, when a user intends to close the door 30, as shown in FIG. 18, the hook release part 326 of the slider 320 contacts the hook 60 to allow the hook 60 not to be latched to the hook latch part 313 of the switch body. Accordingly, the door 30 becomes unclosable. Accordingly, the door becomes unclosable.

In a state where the door 30 is closed as shown in FIG. 17, when a user manipulates the door handle 72 to open the door 30, or the door switch 300 releases the hook 60 to automatically open the door 30 as shown in FIG. 18, and then the slider 320 moves in direction C to allow the door 30 to be in the closable state, the close protection may not be set, or the motor 83 may not rotate but the drum 84 may vibrate. In this case, if the slider actuator 330 moves in direction b, the slider 320 moves in direction D. In this case, if a user intends to close the door 30, as shown in FIG. 18, the hook release part 326 of the slider 320 contacts the hook 60 to allow the hook 60 not to be latched to the hook latch part 313 of the switch body 310. Accordingly, the door 30 becomes unclosable.

Figure 19:
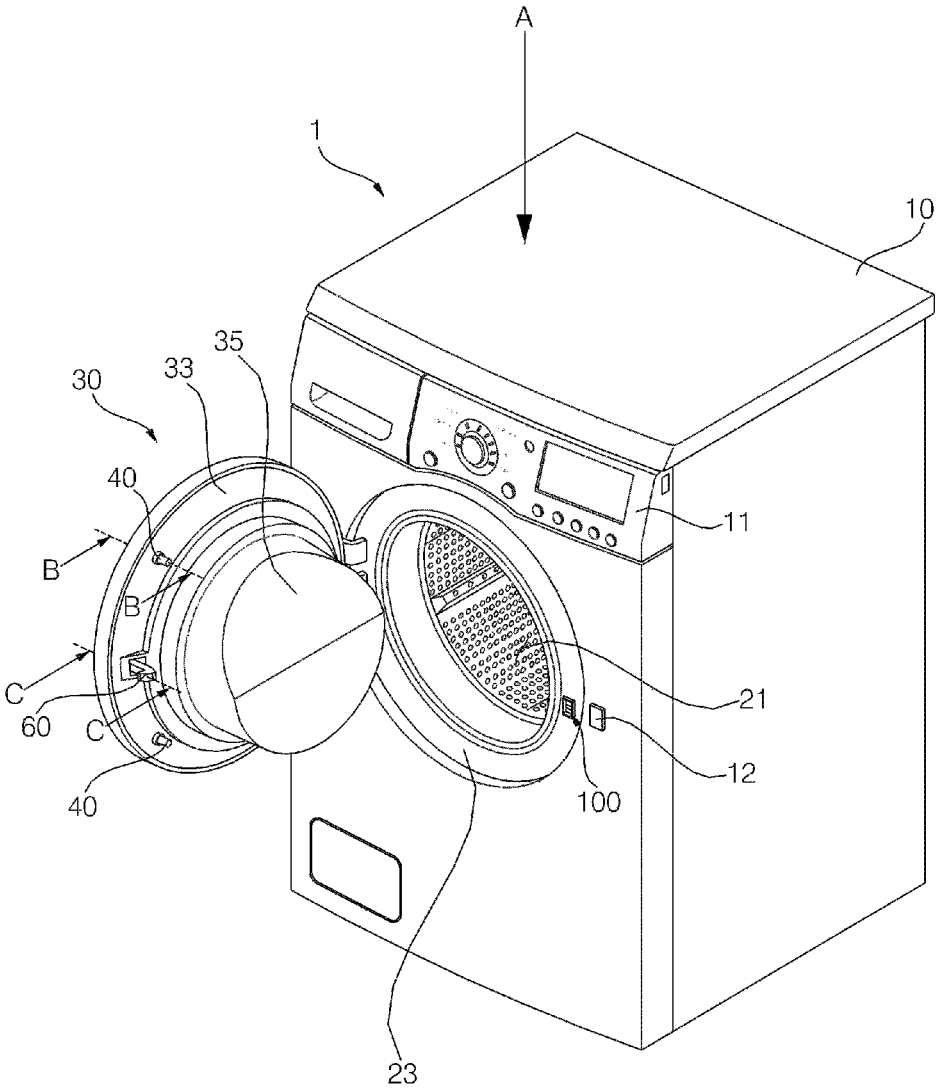
FIG. 19 is a perspective view illustrating a laundry treating apparatus according to still another embodiment of the present invention.

FIG. 19 is a perspective view illustrating a laundry treating apparatus according to still another embodiment of the present invention;

A detailed description of components of the laundry treating apparatus similar to those of the previous embodiments of the present invention will be omitted herein.

The laundry treating apparatus according to still another embodiment of the present invention includes a close protection button 12 disposed near a door switch 100. The close protection button 12 is mechanically linked with the cam 143 shown or the lever 121 shown in FIG. 7, the lever 221 shown in FIG. 12, or the slider 320 shown in FIG. 17 through mechanical components such as gears and links to directly drive the cam 143 or the lever 121 or 221, and the slider 320.

The close protection button 12 may be implemented in various methods using a push button or a rotation-type button, and may be provided with a lock device that avoids manipulation of a user during the laundry treatment.

When laundry is not being performed, and a user manipulates the close protection button 12, the cam 143 or the lever 121 or 221, and the slider 320 operate to allow the hook 60 not to be latched to the door switch 100. Accordingly, the door 30 becomes unclosable.

Figure 20:
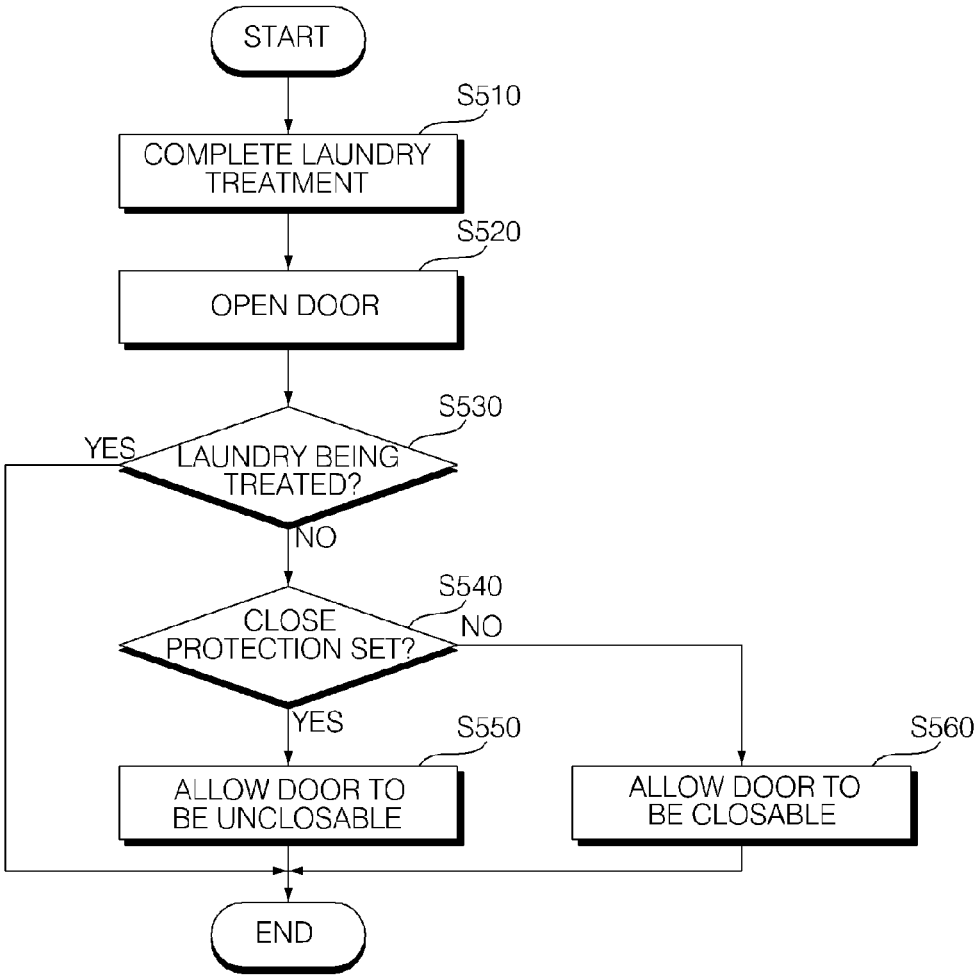
FIG. 20 is a flowchart illustrating a method for controlling a laundry treating apparatus according to an embodiment of the present invention.

FIG. 20 is a flowchart illustrating a method for controlling a laundry treating apparatus according to an embodiment of the present invention.

In operation S520, the laundry treatment is completed through processes of removing contaminants from the laundry, spraying vapor to the laundry, and spinning or drying the laundry. When the laundry treatment is completed, a door is automatically opened in operation S520.

When the door 30 is set to be automatically opened after the laundry treatment, the door switch 100 releases the hook 60 to automatically open the door 30 as shown in FIG. 9, 14 or 18. After the laundry treatment, a user may manipulate the door handle 72 to manually open the door 30.

If the door 30 opens, in operation S530, it is determined whether the laundry is being processed. When the laundry is being processed, and the door 30 is in closed state, if the door close protection is performed in operation S550, the door switch 100 may release the hook 60 to automatically open the door 30 as shown in FIG. 9, 14 or 18. Accordingly, even after the laundry treatment is completed, it is preferable to determined whether the laundry is being processed before the door close protection is performed in operation S550.

In operation S540, it is determined whether the close protection is set. A user may manipulate the close protection button 11*a* or the course selector 11*c* to set the door 30 not to be closed. A user may set the close protection at any time before the initiation of the laundry treatment is initiated, during the laundry treatment, before opening of the door 30 after the completion of the laundry treatment, or after the opening of the door 30.

When the laundry treatment is initiated without a separate manipulation of a user, or the door 30 opens after the completion of the laundry treatment, the close protection may also be automatically set.

When the close protection is set, the door 30 is allowed not be closed in operation S550. When a user manipulates the close protection button 11*a* or the course selector 11*c* to set the door 30 not to be closed, the door 30 becomes unclosable as shown in FIG. 11, 16, or 18. Since the lever 121 contacts the hook 60, or the hook release part 326 of the slider 320 contacts the hook 60, the hook 60 is not latched to the lower switch body 111, thereby allowing the door 30 to be unclosable.

When the door switch 100 releases the hook 60 to automatically open the door 30 in operation S520, the motor 141 does not operate to allow the lever 121 to stay rotated as shown in FIG. 11, the solenoid 241 does not operate to allow the lever 121 to stay rotated as shown in FIG. 16, or the slider actuator 330 does not operates to allow the slider 320 to stay moved in direction D as shown in FIG. 18. Thus, the door is allowed to be unclosable.

In operation S520, when a user manipulates the door handle 72 to manually open the door 30, the motor operates to rotate the lever 121 as shown in FIG. 11, the solenoid 241 moves backward to rotate the lever 221 as shown in FIG. 17, or the slider actuator 330 moves in direction B and the slider 320 move in direction D to allow the door 30 to be unclosable as shown in FIG. 18.

In operation S560, when the close protection is not set, the door is allowed to be closable. When a user sets the door 30 not to be closed, the door 30 becomes closable as shown in FIG. 10, 15, or 17. The door 30 is allowed to be closable by allowing the hook 60 to be latched to the lower switch body 111.

When a user manipulates the door handle 72 to manually open the door 30 in operation S520, the motor 141, the solenoid 241, or the slider actuator 330 may not operate to allow the door 30 to be closed.

When a door switch 100 releases the hook 60 to automatically open the door 30 in operation S520, the motor 141 operates to rotate the lever 121 to the original position as shown in FIG. 10, the solenoid 241 moves forward to return the lever 221 to the original position as shown in FIG. 15, or the slider actuator 330 moves in direction A and the slider 320 moves in direction C as shown in FIG. 17, thereby allowing the door to be closable.

Figure 21:
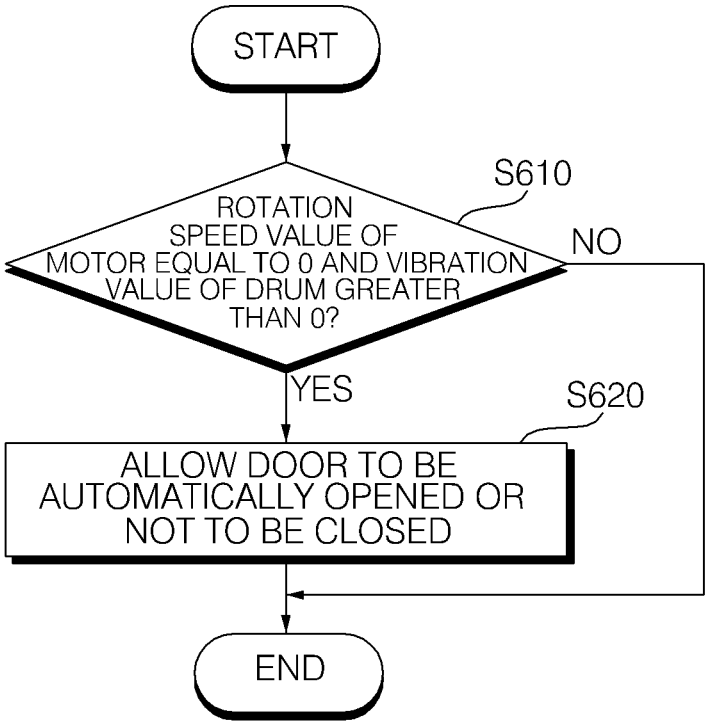
FIG. 21 is a flowchart illustrating a method for controlling a laundry treating apparatus according to another embodiment of the present invention.

FIG. 21 is a flowchart illustrating a method for controlling a laundry treating apparatus according to another embodiment of the present invention.

In operation S610, it is determined whether the drum 84 vibrates without the rotation of the motor 83 before or after the laundry treatment. The rotation of the motor 83 and the vibration of the drum 84 are determined by determining whether the rotation speed value of the motor measured by the rotation sensor 87 is 0 and the vibration value of the drum 84 measured by the vibration sensor 89 is greater than 0. When the laundry treating apparatus 1 does not operate, and a child enters the drum 84, the drum may vibrate without the rotation of the motor 83. Thus, it is determined whether a child has entered the drum 84, using the rotation of the motor 83 and the vibration of the drum 84.

When the motor 83 does not rotate and the drum vibrates, in operation S620, the door 30 is allowed to be automatically opened or not be closed.

When the door 30 is closed, the door switch 100 releases the hook 60 to automatically open the door 30 as shown in FIG. 9, 14, or 18.

When the door 30 is opened, the door 30 becomes unclosable as shown in FIG. 11, 16, or 18. Since the lever 121 contacts the hook 60, or the hook release part 326 of the slider 320 contacts the hook 60, the hook 60 is allowed not to be latched to the lower switch body 111, thereby allowing the door 30 to be unclosable.

Since allowing the door switches 100, 200 and 300 to automatically open the door 30 or allowing the door 30 not to be closed correspond to the same operations as rotating the leer 121 by operating the motor 141, the rotating the lever 221 by moving backward the solenoid 241, or the movement of the slider actuator 330 in direction B and the movement of the slider 320 in direction d, it is unnecessary to determine whether the door 30 is opened.

That is, when the motor 83 does not rotate and the drum vibrates, the motor 141 rotates the lever 121, the solenoid 241 moves backward to rotate the lever 221, or the slider actuator 330 moves in direction B and the slider 320 moves in direction D regardless of the opening and closing of the door 30.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

According to the laundry treating apparatus of the disclosure, one or more effects as follows may be achieved.

First, the door can be set not to be closed for preventing an accident when a child enters the drum.

Second, the door switch allows the door not to be closed.

Third, close protection is set by manipulation of the close protection button.

Fourth, the door is automatically opened when a child enters the drum.

Fifth, the door can be set not to be closed when a child enters the drum.

Sixth, it is determined whether a child has entered the drum, using the rotation of the motor and the vibration of the drum.

It should be noted that other effects may be realized from the understanding of the claims and from the practice of one skilled in the art.

What is claimed is:

1. A laundry treating apparatus comprising:

a cabinet defining an external appearance and having a laundry loading hole for laundry;

a drum housing the laundry and rotatably installed;

a motor rotating the drum;

a door rotatably coupled to the cabinet to open and close the laundry loading hole;

a door switch to open or close the door;

a hook provided in the door to latch on the door switch for closing the door;

a rotation sensing unit to sense the rotation of the motor;

a vibration sensing unit to sense the vibration of the drum;

a controller to release the hook from the door switch to open the door when the rotation sensor does not sense the rotation of the motor and the vibration sensor senses the vibration of the drum; and a support unit mounted in the door to contact the cabinet and maintain a certain separation gap between the door and the cabinet when the door is opened.

2. The laundry treating apparatus of claim 1, wherein the door switch comprises:

a switch body to which the hook is latched; and a lever rotatably coupled to the switch body and contacting the hook to allow the hook not to be latched to the switch body.

3. The laundry treating apparatus of claim 2, wherein the door switch further comprises a lever driving unit for rotating the lever such that the lever is not latched to the door switch.

4. The laundry treating apparatus of claim 3, wherein the lever driving unit comprises:

a cam that is rotatable; and a follower contacting the cam and rectilinearly moving to rotate the lever.

5. The laundry treating apparatus of claim 4, wherein the cam rotates in linkage with the close protection button when the close protection button is manipulated.

6. The laundry treating apparatus of claim 4, wherein the lever driving unit further comprises a motor for rotating the cam when the close protection is set by the manipulation of the close protection button.

7. The laundry treating apparatus of claim 3, wherein the lever driving unit rotates the lever in linkage with the close protection button when the close protection button is manipulated.

8. The laundry treating apparatus of claim 3, wherein the lever driving unit comprises a solenoid generating a rectilinear force to rotate the lever.

9. The laundry treating apparatus of claim 1, wherein the door switch comprises:

a switch body to the hook is latched; and a slider slidably provided in the switch body and contacting the hook to prevent the hook from latching to the door switch.

10. The laundry treating apparatus of claim 9, further comprising:

a slider actuator for moving the slider, wherein the controller controls the slider actuator to move the slider.

* * * * *